US009677333B1

(12) United States Patent
Guthrie et al.

(10) Patent No.: US 9,677,333 B1
(45) Date of Patent: Jun. 13, 2017

(54) UNFURLABLE RESCUE LADDER

(71) Applicant: Climb Tech, LLC, Austin, TX (US)

(72) Inventors: Karl Guthrie, Austin, TX (US); Ivan A. J. Kekahuna, Austin, TX (US)

(73) Assignee: Climb Tech, LLC, Austin, TX (US)

( * ) Notice: Subject to any disclaimer, the term of this patent is extended or adjusted under 35 U.S.C. 154(b) by 0 days.

(21) Appl. No.: 14/504,152

(22) Filed: Oct. 1, 2014

(51) Int. Cl.
*E06C 1/52* (2006.01)

(52) U.S. Cl.
CPC ..... *E06C 1/52* (2013.01)

(58) Field of Classification Search
CPC . E06C 7/186; E06C 7/152; E06C 1/52; A62B 35/04
See application file for complete search history.

(56) References Cited

U.S. PATENT DOCUMENTS 199,967 A * 2/1878 Elton ..... E06C 1/56 182/196
580,454 A * 4/1897 Gates ..... E06C 1/56 182/196
641,741 A * 1/1900 Travers ..... E06C 1/56 182/196
3,703,218 A * 11/1972 Brda ..... B61B 12/005 182/13
4,709,783 A * 12/1987 Tomioka ..... A62B 1/00 182/198
2008/0060872 A1* 3/2008 Wise ..... A62B 35/0075 182/3
2015/0275580 A1* 10/2015 Canfield ..... E06C 7/48 182/8

* cited by examiner

*Primary Examiner* — Alvin Chin-Shue
(74) *Attorney, Agent, or Firm* — Portland Intellectual Property, LLC

(57) ABSTRACT

An unfurlable rescue ladder. The ladder includes a progress capture element allowing someone who deploys the ladder for rescuing a person who has fallen to also assist the person to climb the ladder.

12 Claims, 7 Drawing Sheets

UNFURLABLE RESCUE LADDER

FIELD OF THE INVENTION

The present invention relates to an unfurlable rescue ladder for emergency rescue.

BACKGROUND

An exemplary prior art unfurlable rescue ladder is sold by Guardian Fall Protection Inc. of Kent, Wash., marketed as the "rapid deployment rescue ladder." It is used for rescuing fallen workers, such as in the construction industry. The ladder is light in weight, typically formed entirely or at least primarily of a fabric material, and is easily rolled up or folded for compact stowage in a weather resistant carrying container. The ladder is unfurled for use by another worker seeking to assist the fallen worker. If the fallen worker is not able to climb up the ladder, the worker who deployed the ladder can use it to climb down to assist the fallen worker.

Similar light weight, unfurlable ladders are used for mountain/rock climbing. An example is the "8-Step Ladder Aider" marketed by Metolius Mountain Products, Inc. of Bend, Oreg. The ladder aider, or simply "aider," is typically anchored to an "ascender," a device that is fitted securely around a rope the climber climbs. The rope has been previously positioned and anchored so as to hang down from the top of the climbing objective, and so it is called a "top rope." The ascender is adapted to slide on the rope in one direction only, being prevented by friction from sliding in the reverse direction, and is oriented for climbing so that its sliding direction is upward. The climber wears a harness that is attached via a lanyard to the ascender. As the climber climbs the rope, the climber drags the ascender up the rope, the aider along with it. As the ascender captures the climber's progress by resisting downward sliding, the climber may step on the rungs of the aider and use it as a climbing assist.

A device known as a "progress capture pulley" is also sometimes used in mountain/rock climbing, and is often used in construction, for hauling equipment. A rope is passed over a sheave and a cam allows the rope to feed through the pulley in one direction but not the other.

SUMMARY

An unfurlable rescue ladder is disclosed herein. The ladder includes a hanger element, a ladder portion, a connecting element, a rope, and a progress capture element.

The hanger element has a connecting aperture therethrough that is either "closed" or "closeable;" the connecting element has a connecting aperture therethrough that is either "closed" or "closeable;" the progress capture element has a connecting aperture therethrough, and a separate rope-passing aperture therethrough for passing the rope through the progress capture element, the connecting and rope-passing apertures being either "closed" or "closeable."

Either a plurality of rung elements are attached to each other in sequence so as to form of a chain of rung elements with a first end of the chain depending from the hanger element, or a plurality of rung elements are attached to and between rail elements in sequence with respective first ends of the rail elements depending from the hanger element.

The hanger element is connected to the first connecting member and the first connecting member is connected to the progress capture mechanism. More specifically, to the hanger element is connected to the first connecting member such that a portion of that portion of the hanger element that surrounds the connecting aperture through the hanger element passes through the connecting aperture through the first connecting element, and a portion of that portion of the first connecting element that surrounds the connecting aperture through the first connecting element passes through the connecting aperture through the hanger element, and the first connecting member is connected to the progress capture element such that a portion of that portion of the connecting element that surrounds the connecting aperture through the connecting element passes through the connecting aperture through the progress capture element, and a portion of that portion of the progress capture element that surrounds the connecting aperture through the progress capture element passes through the connecting aperture through the first connecting element.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENTS

Figure 1:
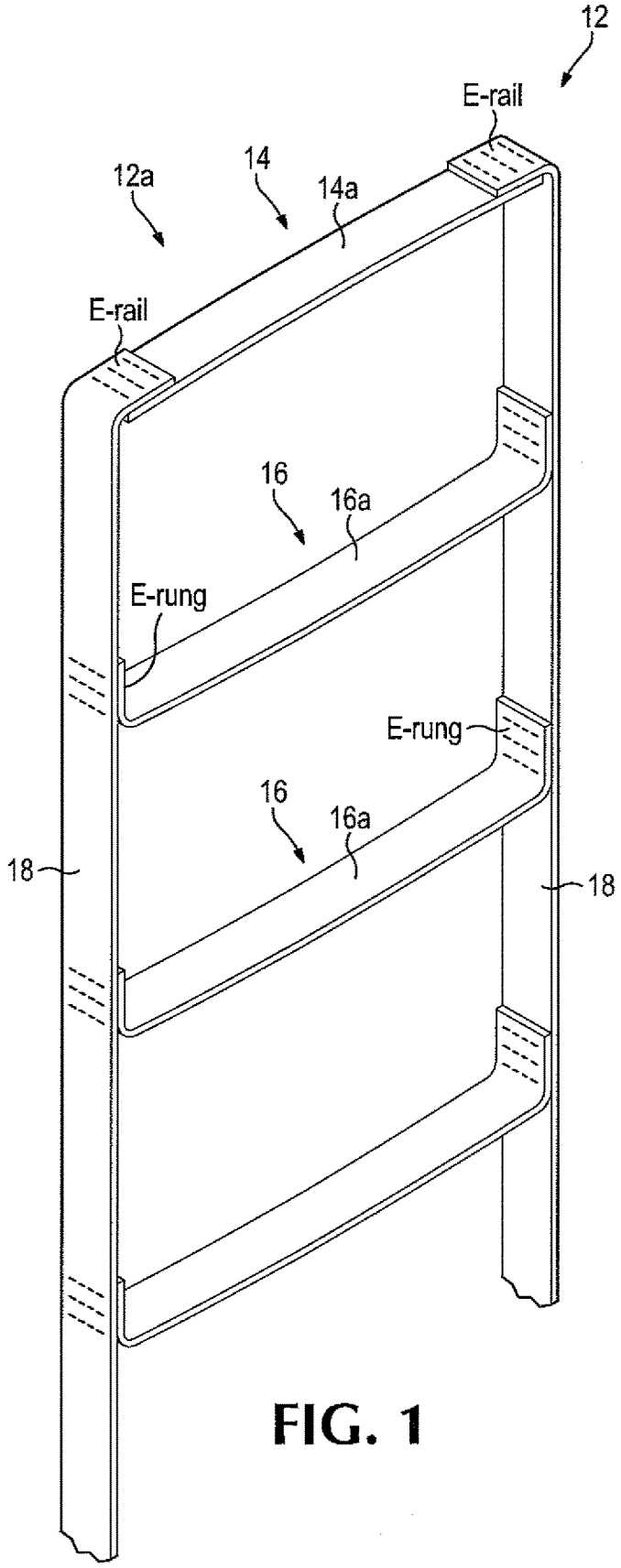
FIG. 1 is an isometric drawing of a first configuration of a ladder portion of an unfurlable rescue ladder according to the present invention.
Figure 2:
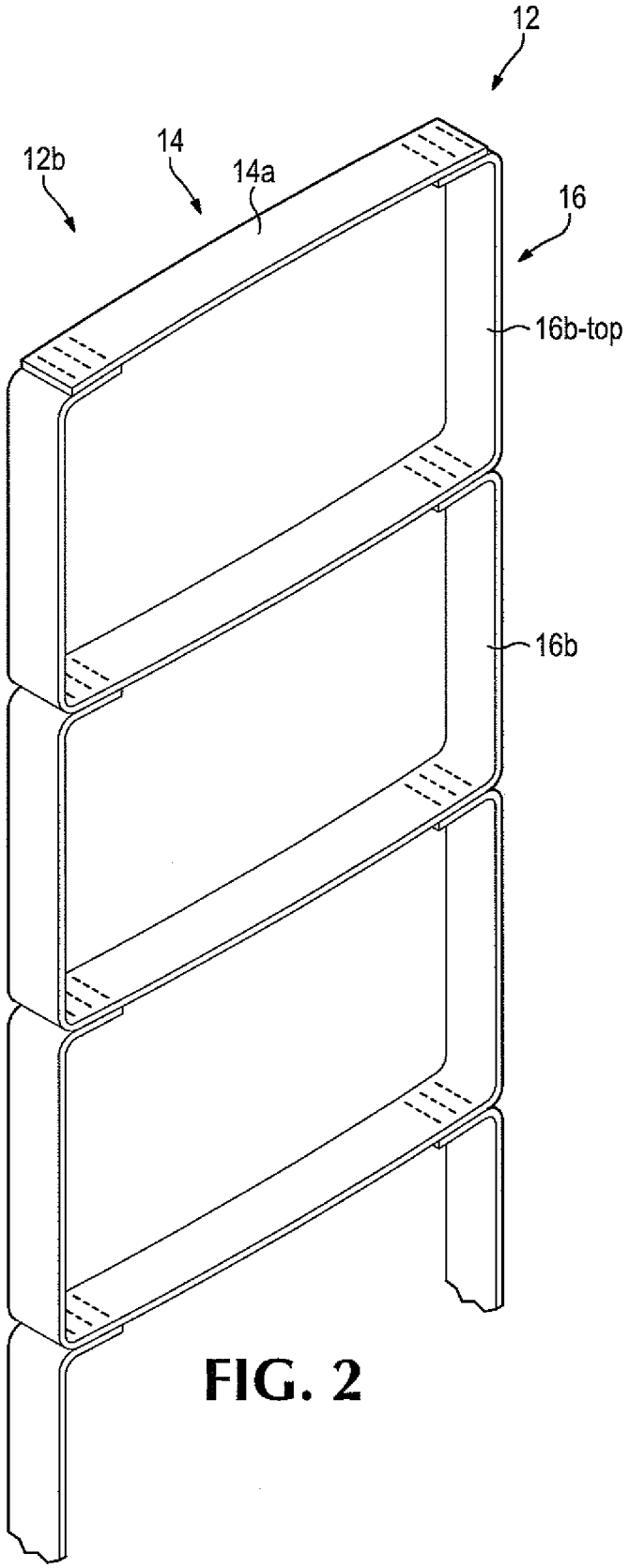
FIG. 2 is an isometric drawing of a second configuration of a ladder portion of an unfurlable rescue ladder according to the present invention.
Figure 3:
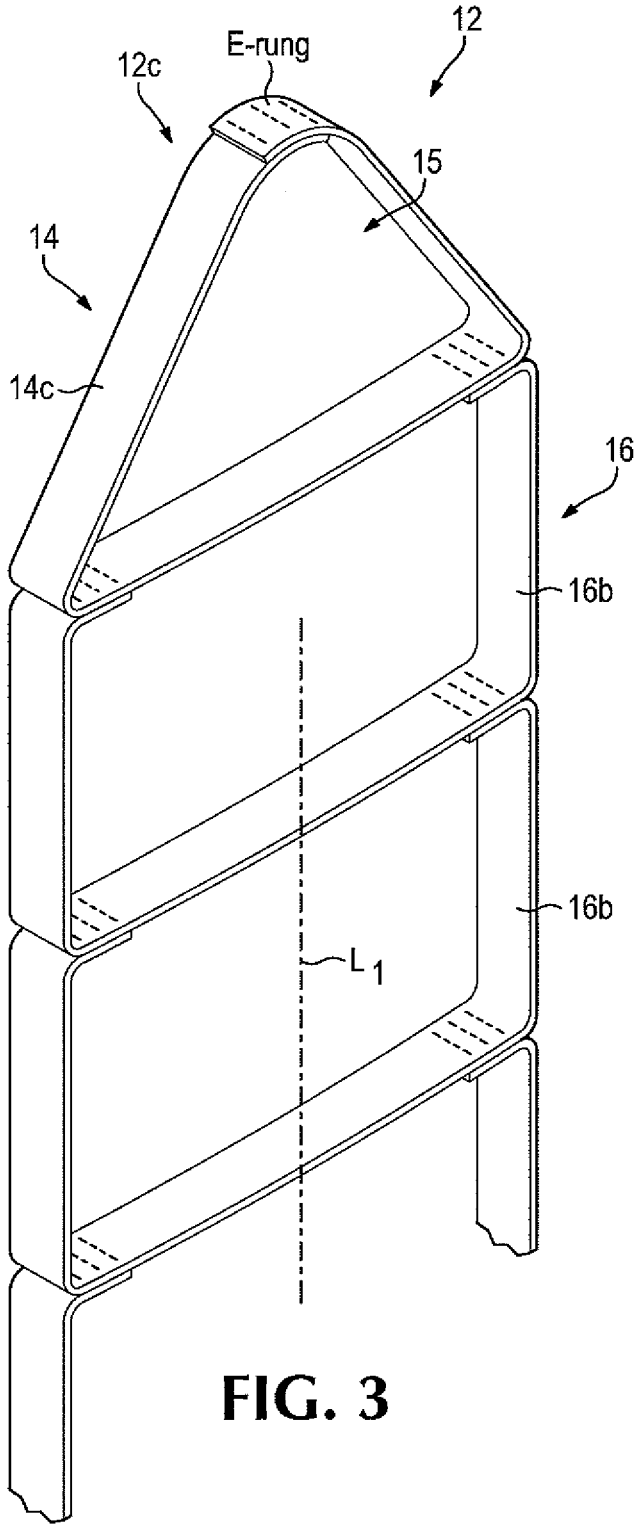
FIG. 3 is an isometric drawing of a third configuration of a ladder portion of an unfurlable rescue ladder according to the present invention.

FIGS. 1-3 show various configurations of a ladder portion 12 of an unfurlable rescue ladder 10 according to the present invention. Each of the configurations includes a hanger 14 and a plurality of substantially identical rung elements 16.

The ladder 10 is provided with sufficient strength to satisfy a load requirement of 310 pounds, and the hanger and rung elements are formed primarily of a flexible material so that the ladder can be rolled up, or folded, for compact storage, and unfurled when needed. Preferably the material of which the hanger and rung elements are at least primarily formed is a lightweight and weatherproof fabric material such as nylon webbing, though they may include relatively rigid materials such as aluminum, fiberglass, or carbon fiber reinforced polymer to provide rigidity where needed, such as on the rungs where a user of the ladder would step.

FIG. 1 shows a first configuration 12*a* of the ladder portion 12 having a hanger 14*a* and rung elements 16*a*, along with side rails 18. Like the hanger and rung elements, the side rails 18 are formed primarily of a flexible material provided with sufficient strength to satisfy the load requirement; and preferably the material of which the side rails 18 are primarily formed is a lightweight and weatherproof fabric material such as nylon webbing, though they may include relatively rigid materials such as aluminum, fiberglass, or carbon fiber reinforced polymer to provide rigidity or heft where needed, such as at the bottom end of the side rails.

The rung elements 16*a* are attached to and between the rails 18 in sequence at opposite ends "E-rung" of the rung elements, with opposed ends "E-rail" of the rail elements 18 attached to the hanger 14*a*. Attachment of the rails to the hanger, and the rung elements to the rails, may be by any satisfactory means. Where the hanger, side rails and rung elements are all formed of fabric material, they are preferably joined together by stitches, though other joining means could be used so long as the ladder 10 satisfies the load requirement. For example, if it would be possible to satisfy the load requirement, the elements of fabric material may be joined together by use of an adhesive.

FIG. 2 shows a second configuration 12*b* of the ladder portion 12 incorporating the hanger 14*a* of the first configuration 12*a* with modified rung elements 16*b* that eliminate the need for side rails.

The rung elements 16*b* are attached to each other in sequence so as to form of a chain of rung elements, with a rung element 16*b*-top that defines the top-most rung element of the chain depending from the hanger 14*a*. Attachment of the rung elements 16*b* to each other, and attachment of the rung element 16*b*-top to the hanger, may be by any satisfactory means. Where the hanger and rung elements are all formed of fabric material, they are preferably joined together by stitches, though other joining means could be used so long as the ladder 10 satisfies the load requirement. For example, if it would be possible to satisfy the load requirement, the elements of fabric material may be joined together by use of an adhesive.

FIG. 3 shows a third configuration 12*e* of the ladder portion 12 incorporating the rung elements 16*b* of the second configuration 12*b* with the ends E-rung of the top rung element 16*b*-top (FIG. 2) either being joined together or eliminated to define a modified hanger 14*c*. Where the rung elements are formed of fabric material, the ends of the top rung element are preferably joined together by stitches, though other joining means could be used so long as the ladder 10 satisfies the load requirement. For example, if it would be possible to satisfy the load requirement, the elements of fabric material may be joined together by use of an adhesive.

Figure 4:
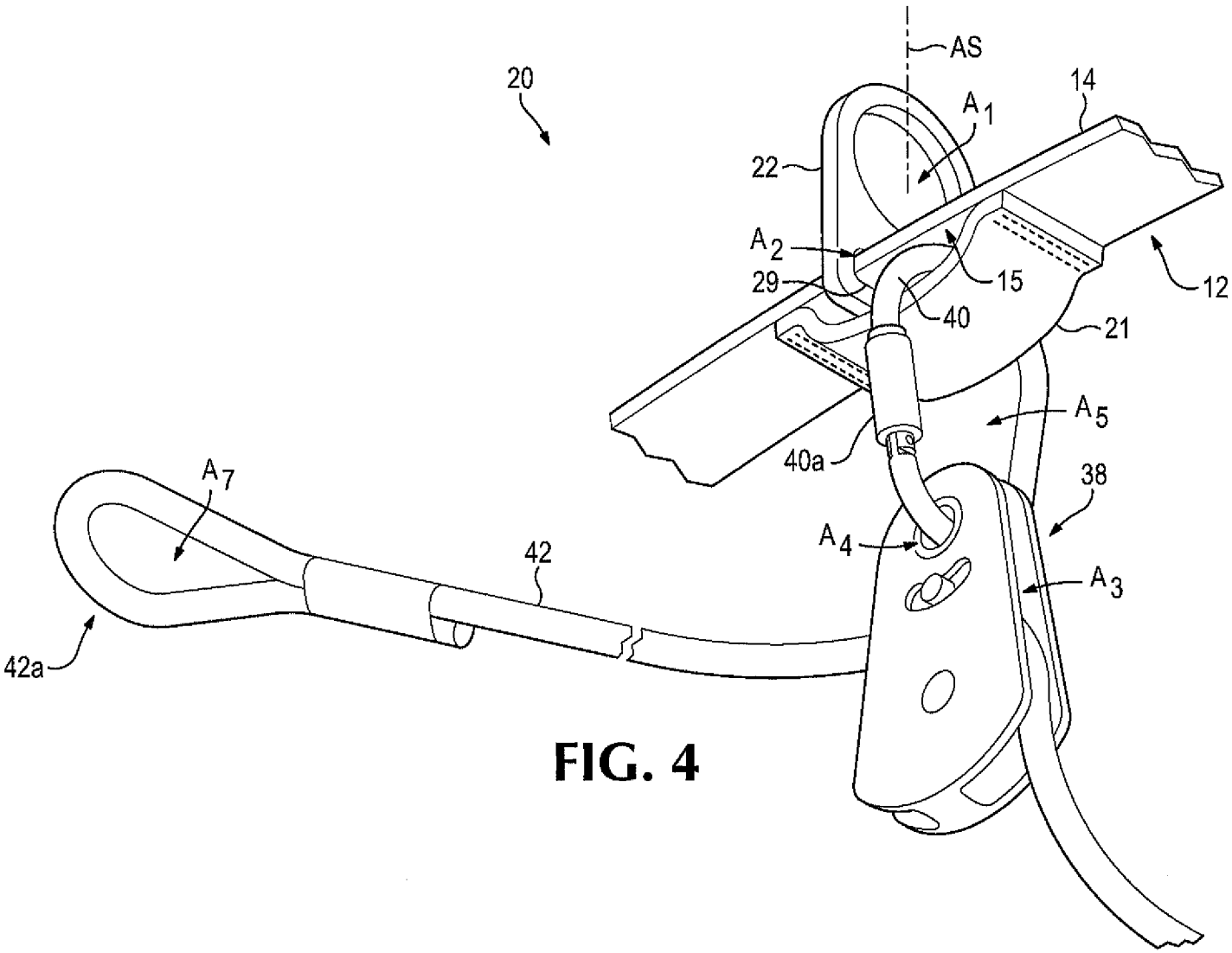
FIG. 4 is an isometric drawing of a connecting assembly for use with the ladder portions of FIGS. 1-3 according to the present invention.

FIG. 4 shows a ladder connecting assembly 20 for anchoring the ladder portion 12 and providing for a novel "progress capture" function of the rescue ladder 10.

For use with the ladder connecting assembly 20, the hanger 14 preferably provides a through-aperture 15. The aperture 15 may be provided by any satisfactory means, such as being inherently provided by the through-aperture defined by the hanger 14*c* of FIG. 3. Where the hanger is formed of fabric material, the aperture 15 may be formed more specifically by attaching an additional length of fabric material 21 to the hanger 14, such as by stitches, though other joining means could be used so long as the ladder 10 satisfies the load requirement. For example, if it would be possible to satisfy the load requirement, the fabric material used for forming the aperture 15 may be joined to the hanger 14 by use of an adhesive.

The aperture 15 is preferably centrally located on the hanger 14, on the bilateral ladder axis indicated in FIG. 3 as "$L_1$."

The aperture 15 is "closed," meaning for purposes herein that it is contiguously surrounded by structure such that a ring encircling any portion of the structure and passing through the aperture cannot be removed from the aperture without either manipulating or damaging the structure or manipulating or damaging the ring. At the other extreme, an aperture is "open" if the ring can be removed from the aperture without contact between the structure and the ring. Between these extremes, an aperture is "closeable" if the structure defining the aperture can be selectably manipulated to provide for repetitively opening (obtaining the "open" configuration) or closing (obtaining the "closed" configuration) the aperture as desired.

An example of a "closed" aperture is that defined through a ring, an example of an "open" aperture is that defined through a hook, and an example of a "closeable" aperture is that defined through a carabiner. In cases where an aperture is "closeable," it will be understood that "the structure surrounding the aperture" refers to the structure surrounding the aperture when the aperture is closed.

Potentially, a ring could fall out of an "open" aperture. This is also possible, though less likely, if the structure surrounding the aperture is merely "closeable" rather than being "closed," the latter providing a maximally secure means of attachment and is preferred if it is not necessary to allow a user to change the configuration of the aperture.

The ladder connecting assembly 20 includes a ladder attachment connector 22 such as the D-ring shown in FIG. 4. The ladder attachment connector 22 has two separate through-apertures $A_1$ and $A_2$. Like the aperture 15, the apertures $A_1$ and $A_2$ are preferably "closed" for maximum security of attachment. Alternatively, however, they could be merely "closeable."

D-rings are specific structures that are well known in the climbing arts. They may be defined generally for purposes herein as having a bilateral axis of symmetry "AS" (see FIG. 4), where the aperture $A_1$ defines an arc of a circle extending at least 180 degrees, more preferably at least 270 degrees, and most preferably 360 degrees, which is centered about the axis AS, and where the aperture $A_2$ has an area that is substantially smaller than the area of the aperture $A_1$ by at least 10%, and has a substantially different shape due to at least the majority of its perimeter being defined by rectilinear rather than curvilinear lines, such as the edge 29.

To connect the connector 22 to the ladder portion 12, a portion of that portion of the connector 22 that surrounds the aperture $A_2$ of the connector 22 is passed through the aperture 15 of the hanger 14; and a portion of that portion of the hanger 14 that surrounds the aperture 15 is passed through the aperture $A_2$.

The ladder connecting assembly 20 further includes a progress capture mechanism 38, which may be either an ascender or a progress capture pulley as known and commercially provided in the climbing arts. As is standard, the progress capture mechanism 38 has two separate through-apertures $A_3$ and $A_4$. The apertures $A_3$ and $A_4$ are typically "closed" in commercial embodiments, but either or both of these apertures could be "closeable" instead.

The aperture $A_3$ is for passing a rope 42 through the progress capture mechanism 38. For use with the progress capture mechanism, the term "rope" is defined to mean any rope or equivalent article of manufacture commercially provided in the climbing arts for climbing purposes.

Ideally, the progress capture mechanism 38 allows the rope 42 to pass freely through the aperture $A_4$ in one direction, and prevents passage of the rope through the aperture $A_4$ in the opposite direction. As a practical minimum requirement, the progress capture mechanism should allow for passing the rope in the favored direction with at least ten times less force than would be needed to overcome the resistance the progress capture mechanism provides to passing the rope in the opposite direction.

A connector 40 is used to connect the ladder portion 12 to the progress capture mechanism 38. For this purpose, the connector 40 has a through-aperture $A_5$ which, like the apertures $A_1$ and $A_2$ of the connector 22, may be either "closed" or "closeable." The connector 40 may be a carabiner.

To connect the connector 40 to the ladder portion 12, a portion of that portion of the hanger 14 that surrounds the aperture 15 of the ladder portion 12 is passed through the aperture $A_5$ of the connector 40; and a portion of that portion of the connector 40 that surrounds the aperture $A_5$ is passed through the aperture 15.

Figure 5:
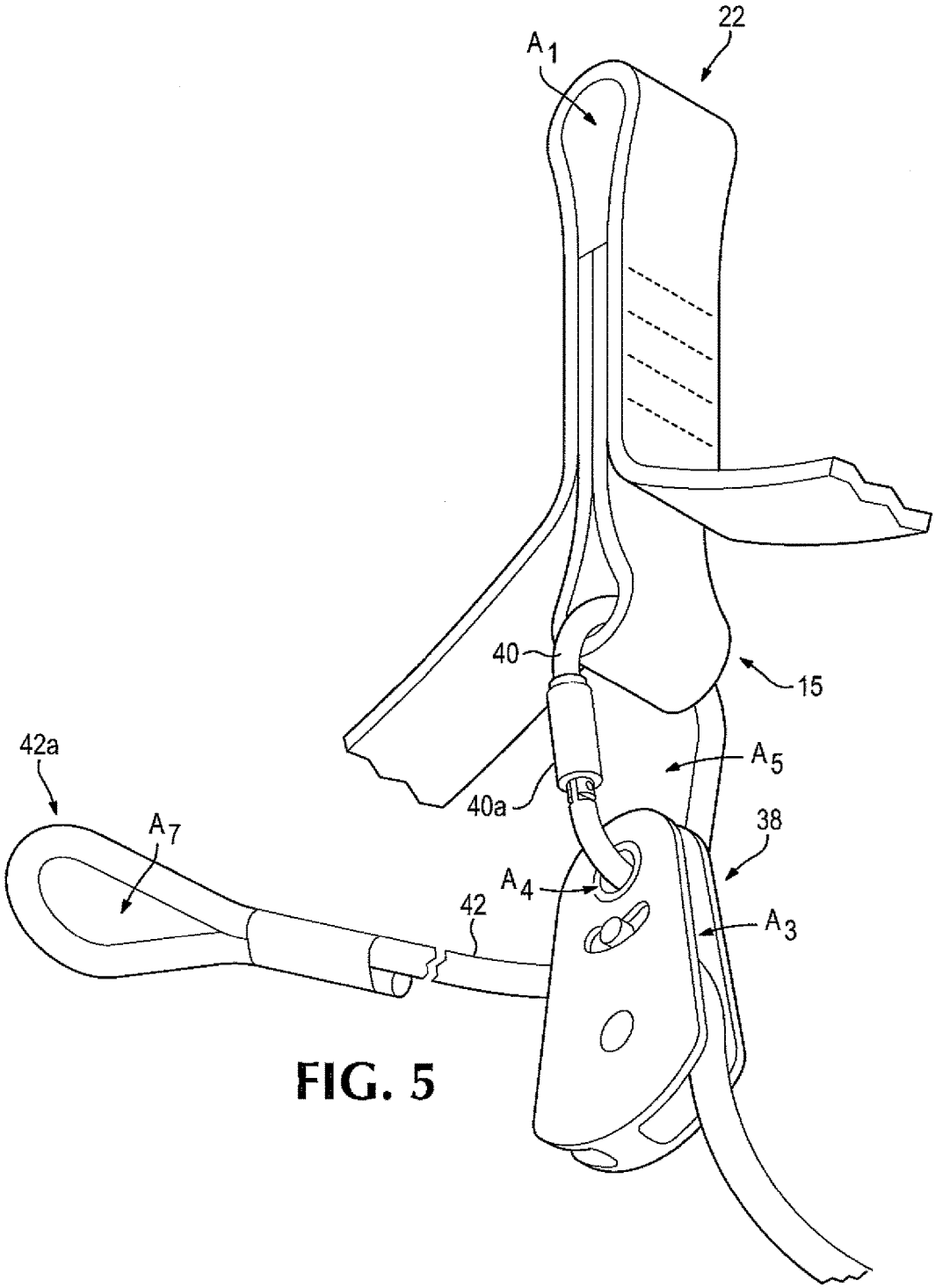
FIG. 5 is an isometric drawing of a preferred alternative connecting assembly for use with the ladder portions of FIGS. 1-3 according to the present invention.

Similarly, to connect the connector 40 to the progress capture mechanism 38, a portion of that portion of the progress capture mechanism that surrounds the aperture $A_4$ of the progress capture mechanism is passed through the aperture $A_5$ of the connector 40; and a portion of that portion of the structure that surrounds the aperture $A_5$ is passed through the aperture $A_4$.

Where the ladder portion 12 is formed of fabric material, the ladder connector 22 may be provided as shown in FIG. 5. In such case, it may be advantageous to likewise form the ladder connector 22 of fabric material. The ladder connector 22 in this embodiment may an extension or integral part(s) of the same fabric material used in the ladder portion 12, or it may include one or more additional lengths of fabric material joined to the hanger 14 and/or to each other. Where the ladder connector 22 includes one or more additional lengths of fabric material, the one or more additional lengths of fabric material are preferably joined to the hanger 14 and/or to each other by stitches, though other joining means could be used so long as the ladder 10 satisfies the load requirement. For example, if it would be possible to satisfy the load requirement, the one or more additional lengths of fabric material may be joined to the hanger 14 and/or to each other by use of an adhesive.

FIG. 5 provides an example where the hanger 14 of the ladder portion 12 as in any of the embodiments shown in FIGS. 1-3 may be modified to incorporate the ladder connector 22, with stitches provided such as are indicated to form the aforementioned through-aperture $A_1$.

Since the connector 22 is either part of or attached to the hanger 14, there is no need for the through-aperture $A_2$ provided in the D-ring embodiment of the ladder connector 22 shown in FIG. 4. It will be readily appreciated that numerous alternative configurations of the fabric embodiment of the ladder connector 22 are possible.

Figure 6:
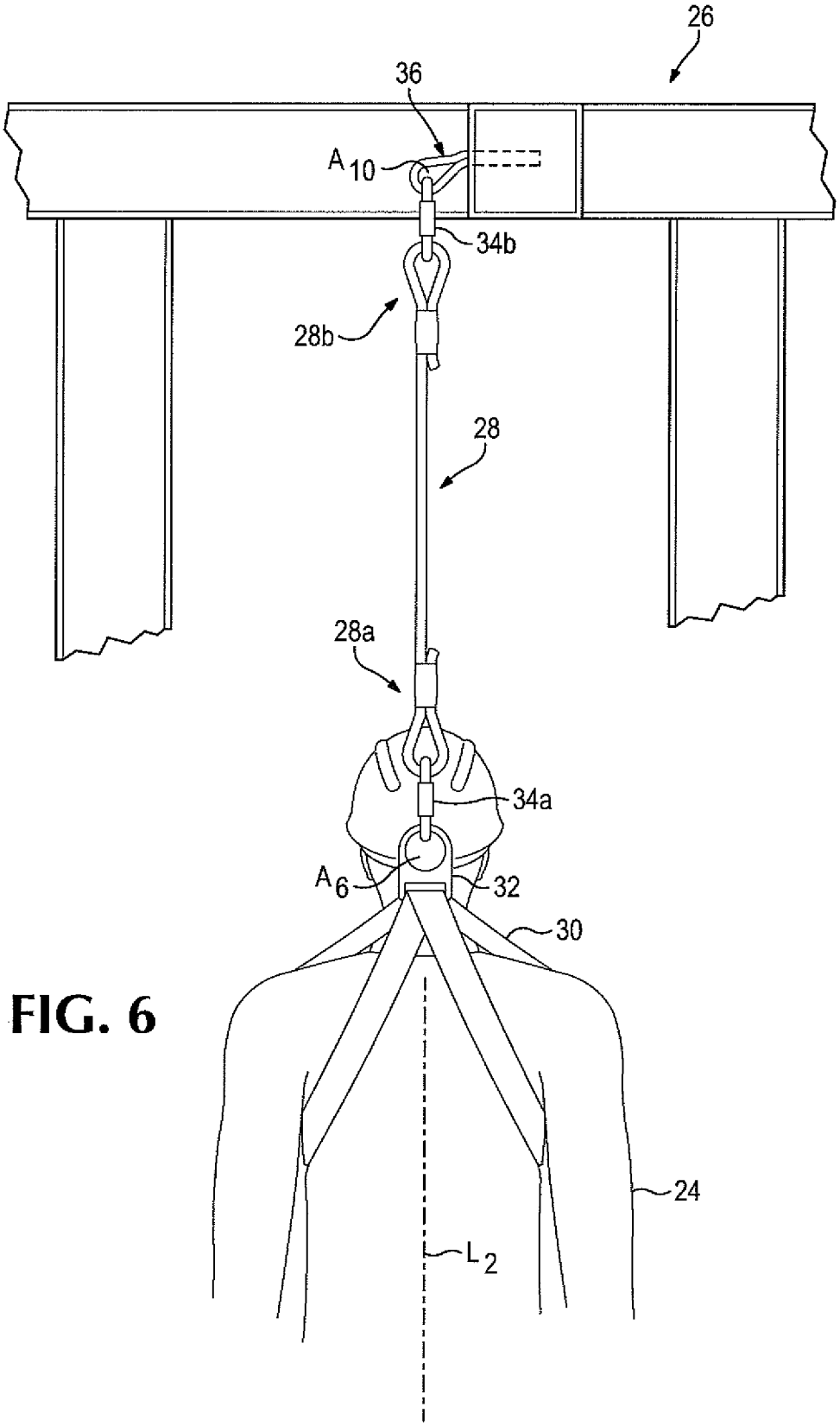
FIG. 6 is an elevation view of a user of an unfurlable rescue ladder according to the present invention attached to a lanyard.

Turning now to FIG. 6, a typical safety line is shown for supporting a worker 24 who has fallen from a building 26. The worker falls only a short distance as a result of being tied to the building by a lanyard 28. The lanyard is designed to controllably lengthen as the worker falls to absorb shock.

The lanyard 28 is connected at one end 28*a* to a harness 30 worn by the worker at a D-ring connector 32 via a first carabiner 34*a*. The connector 32 has a through-aperture $A_6$ which corresponds to, and which may have the same attributes as, the aperture $A_1$ of the connector 22. The other end 28*b* of the lanyard is connected to the building 26 at an anchor point 36 via a second carabiner 34*b*.

The carabiner 34*b* has a through-aperture (not visible in FIG. 6) that is "closeable," and the anchor point 36 has a through-aperture $A_{10}$. To connect the lanyard 28 to the anchor point 36, a portion of that portion of the connector 34*b* that surrounds the through aperture of the connector 34*b* is passed through the aperture $A_{10}$ through the anchor point 36; and a portion of that portion of the anchor point 36 that surrounds the aperture $A_{10}$ is passed through the through-aperture of the connector 34*b*.

In general for purposes herein, an anchor point need not have a through-aperture. For example, an anchor point could be a railing, or post, to which the end 28*b* is tied, or around which the end 28*b* is wrapped, using any standard means.

After a worker has fallen from the building 10 as shown in FIG. 6, another person in the building (not shown) may deploy the ladder 10, by connecting it to the building and unfurling it so that it can be accessed by the fallen worker. The connection to the building may be made through the connector 22 by use of an additional connector 46 that will be discussed immediately below in connection with FIG. 7.

Figure 7:
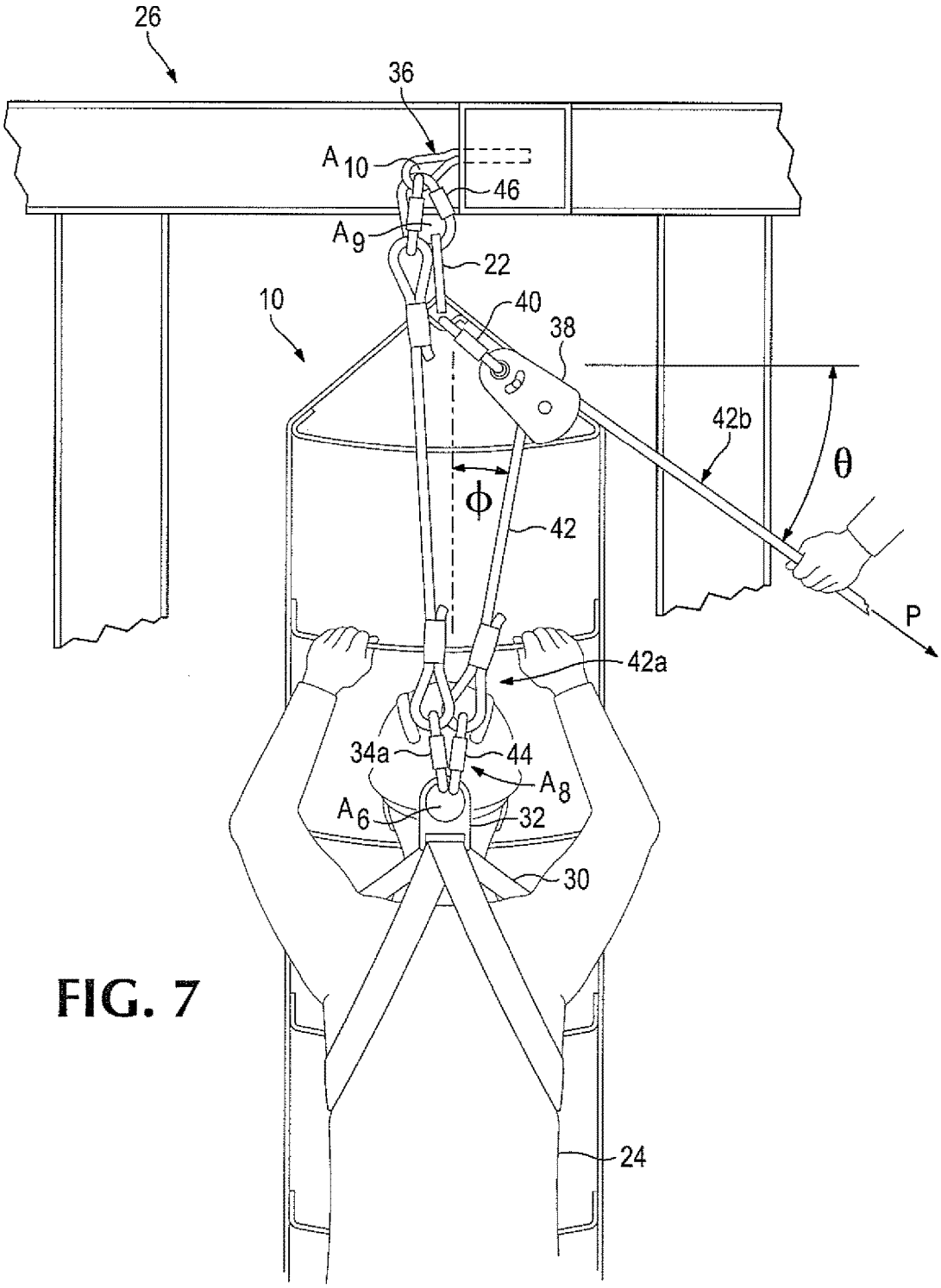
FIG. 7 is an elevation view of a connecting arrangement for connecting the lanyard of FIG. 6 to the connecting assembly of FIG. 5.

However, before the worker fell he/she made the connection shown in FIG. 6 between the end 28*a* of the lanyard and the connector 32 by installing the first carabiner 34*a* himself/herself, typically with the harness 30 already donned. Now with reference to FIG. 7 showing the ladder unfurled and provided to the fallen worker, the worker is likewise able to connect to the rope 42 at the same attachment connector 32 by use of a "closeable" connector 44 connected to a looped end 42*a* of the rope. This allows for the person who deployed the ladder, or a person who is otherwise available to provide assistance, to use the rope 42 and progress capture mechanism 38 to capture the worker's progress as he or she climbs the ladder, by pulling on an end 42*b* of the rope such as where indicated and in the direction indicated by the arrow at "P," to take up the slack in the rope as the worker ascends.

The looped end 42*a* has a through-aperture A, (FIG. 4) that is "closed," but the end 42*a* could be fitted with additional hardware that provides an aperture that is "closeable." The connector 44 shown in FIG. 7 has a through-aperture $A_8$ that cannot be seen in the Figure but is just like the aperture $A_5$ of the connector 40 (see FIG. 4), which is in this case preferably "closeable" so the worker is able to open the aperture to make the connection to the rope 42 and close the aperture thereafter to ensure a safe connection.

To connect the connector 32 to the rope 42, a portion of that portion of the end 42*a* of the rope 42 that surrounds the aperture $A_7$ (FIG. 4) of the end 42*a* is passed through the aperture $A_8$ of the connector 44; and a portion of that portion of the connector 44 that surrounds the aperture $A_8$ is passed through the aperture $A_8$.

To connect the ladder 10 to the building, the connector 22 may be connected to the anchor point 36, or to some other attachment point in the building, by use of an additional connector 46. The connector 46 has a through-aperture $A_9$ which is like the aperture $A_8$ of the connector 44, very preferably being "closeable" so the person deploying the ladder is able to open the aperture to make the connection to the rope anchor point and close the aperture thereafter to ensure a safe connection.

To connect the ladder to the connector 46, a portion of that portion of the connector 22 that surrounds the aperture $A_1$ of the connector 22 is passed through the aperture $A_9$ through the connector 46; and a portion of that portion of the connector 46 that surrounds the aperture $A_9$ is passed through the aperture $A_1$.

To connect the connector 46 to the anchor point 36, a portion of that portion of the connector 46 that surrounds the aperture $A_9$ of the connector 46 is passed through the aperture $A_{10}$ through the anchor point 36; and a portion of that portion of the anchor point 36 that surrounds the aperture $A_{10}$ is passed through the aperture $A_9$.

It should be understood that it is not necessary for the ladder 10 to be connected to the same anchor point as the lanyard 28 that supports the person who has fallen.

Preferably the progress capture mechanism 38 is closely coupled to the mid-point of the hanger 14 of the ladder, so that an angle $\phi$ defined between the rope and the vertical at elevations beneath the progress capture mechanism is minimized, so that the linear translation of the end 42*a* of the rope 42 as the worker climbs the ladder is primarily in the vertical direction, along the ladder axis $L_1$ (FIG. 3). Preferably no more than 20% of this translation is in a direction perpendicular to the vertical.

Preferably, the progress capture mechanism 38 is more specifically a progress capture pulley, so that the angle $\theta$ defined between the rope and the horizontal at elevations above the progress capture mechanism 38 obtained as the assisting person pulls on the rope can be significantly less than 90 degrees, e.g., between zero and 45 degrees.

It is to be understood that, while a specific unfurlable rescue ladder has been shown and described as preferred, other configurations could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. An unfurlable rescue ladder for climbing by a climber, comprising:

a hanger element having a connecting aperture therethrough that is either "closed" or "closeable";

a first connecting element having a connecting aperture therethrough that is either "closed" or "closeable";

a rope;

a progress capture element having a connecting aperture therethrough, and a separate rope-passing aperture therethrough for passing the rope through the progress capture element, the connecting and rope-passing apertures being either "closed" or "closeable," the progress capture element for capturing the climber's climbing progress and therefore allowing for climbing up the rescue ladder but not for climbing down the rescue ladder; and either a plurality of rung elements attached to each other in sequence so as to form a chain of rung elements with a first end of the chain depending from the hanger element, or a plurality of rung elements attached to and between spaced apart rail elements in sequence with respective first ends of the rail elements depending from the hanger element, wherein the hanger element is connected to the first connecting element such that a portion of the hanger element that surrounds the connecting aperture through the hanger element passes through the connecting aperture through the first connecting element, and a portion of the first connecting element that surrounds the connecting aperture through the first connecting element passes through the connecting aperture through the hanger element, and wherein the first connecting element is connected to the progress capture element such that a portion of the connecting element that surrounds the connecting aperture through the connecting element passes through the connecting aperture through the progress capture element, and a portion of the progress capture element that surrounds the connecting aperture through the progress capture element passes through the connecting aperture through the first connecting element.

2. The ladder of claim 1, wherein the progress capture element includes a progress capture pulley.

3. The ladder of claim 2, wherein the first connecting element includes a carabiner.

4. The ladder of claim 1, wherein the first connecting element includes a carabiner.

5. The ladder of claim 4, further comprising a second connecting element having a first connecting aperture therethrough, the first connecting aperture through the second connecting element being either "closed" or "closeable," wherein the second connecting element is connected to the hanger element such that a portion of the hanger element that surrounds the connecting aperture through the hanger element passes through the first connecting aperture through the second connecting element, and a portion of the second connecting element that surrounds the first connecting aperture through the first connecting element passes through the connecting aperture through the hanger element.

6. The ladder of claim 5, further comprising a third connecting element having a connecting aperture therethrough, the connecting aperture through the third connecting element being either "closed" or "closeable," wherein the second connecting element has a second connecting aperture, the second connecting aperture through the second connecting element being either "closed" or "closeable," wherein the second connecting element is connected to third connecting element such that a portion of the second connecting element that surrounds the second connecting aperture through the second connecting element passes through the connecting aperture through the third connecting element, and a portion of the third connecting element that surrounds the connecting aperture through the third connecting element passes through the second connecting aperture through the second connecting element.

7. The ladder of claim 6, wherein an end of the rope has a connecting aperture therethrough which is "closed," further comprising a fourth connecting element having a connecting aperture therethrough which is "closeable," wherein a portion of the end of the rope that surrounds the connecting aperture through the rope passes through the connecting aperture of the fourth connecting element, and wherein a portion of the fourth connecting element that surrounds the connecting aperture through the fourth connecting element passes through the connecting aperture through the end of the rope.

8. The ladder of claim 5, wherein an end of the rope has a connecting aperture therethrough which is "closed," further comprising a third connecting element having a connecting aperture therethrough which is "closeable," wherein a portion of the end of the rope that surrounds the connecting aperture through the rope passes through the connecting aperture of the third connecting element, and wherein a portion of the third connecting element that surrounds the connecting aperture through the third connecting element passes through the connecting aperture through the end of the rope.

9. The ladder of claim 4, wherein an end of the rope has a connecting aperture therethrough which is "closed," further comprising a second connecting element having a connecting aperture therethrough which is "closeable," wherein a portion of the end of the rope that surrounds the connecting aperture through the rope passes through the connecting aperture of the second connecting element, and wherein a portion of the second connecting element that surrounds the connecting aperture through the second connecting element passes through the connecting aperture through the end of the rope.

10. The ladder of claim 3, wherein an end of the rope has a connecting aperture therethrough which is "closed," further comprising a second connecting element having a connecting aperture therethrough which is "closeable," wherein a portion of the end of the rope that surrounds the connecting aperture through the rope passes through the connecting aperture of the second connecting element, and wherein a portion of the second connecting element that surrounds the connecting aperture through the second connecting element passes through the connecting aperture through the end of the rope.

11. The ladder of claim 2, wherein an end of the rope has a connecting aperture therethrough which is "closed," further comprising a second connecting element having a connecting aperture therethrough which is "closeable," wherein a portion of the end of the rope that surrounds the connecting aperture through the rope passes through the connecting aperture of the second connecting element, and wherein a portion of the second connecting element that surrounds the connecting aperture through the second connecting element passes through the connecting aperture through the end of the rope.

12. The ladder of claim 1, wherein an end of the rope has a connecting aperture therethrough which is "closed," further comprising a second connecting element having a connecting aperture therethrough which is "closeable," wherein a portion of the end of the rope that surrounds the connecting aperture through the rope passes through the connecting aperture of the second connecting element, and wherein a portion of the second connecting element that surrounds the connecting aperture through the second connecting element passes through the connecting aperture through the end of the rope.

* * * * *